US006378472B1

(12) United States Patent
Kantola

(10) Patent No.: US 6,378,472 B1
(45) Date of Patent: Apr. 30, 2002

(54) OILING SYSTEM ISOLATION AND REGULATOR VALVE

(75) Inventor: James C. Kantola, Waukegan, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/664,175

(22) Filed: Sep. 19, 2000

(51) Int. Cl.[7] ..... F01M 3/00
(52) U.S. Cl. ..... 123/73 AD
(58) Field of Search ..... 123/1 A, 73 AD, 123/195 P, 196 W, 196 R; 137/218; 285/31, 148.14, 148.21

(56) References Cited

U.S. PATENT DOCUMENTS 4,142,486 A 3/1979 Schreier ..... 123/73 AD
4,178,134 A * 12/1979 Babish et al. ..... 417/181
4,300,489 A * 11/1981 Perrin ..... 123/73 AD
4,907,616 A 3/1990 Bergsma ..... 137/38
4,979,883 A * 12/1990 Neward ..... 417/441
5,297,511 A * 3/1994 Suzuki ..... 123/196 R
5,377,637 A * 1/1995 Leighton et al. ..... 123/73 AD
5,513,608 A * 5/1996 Takashima et al. .... 123/196 W
5,941,745 A 8/1999 Kanno ..... 440/88
5,967,178 A 10/1999 Schrode ..... 137/519

* cited by examiner

*Primary Examiner*—Tony M. Argenbright
*Assistant Examiner*—Hai Huynh
(74) *Attorney, Agent, or Firm*—Timothy J. Ziolkowski

(57) ABSTRACT

An isolation valve and regulator assembly is disclosed for use in a lubrication system of an outboard marine engine. The valve is used to inject and regulate oil flow into the fuel system of the outboard marine engine. The regulating valve has a housing with an inlet to receive a first hose and an outlet to receive a second hose wherein the first and second hoses are non-interchangeable. Since the construction of the valve requires different sized inlet and outlet hoses, reverse installation is prevented. A passage between the inlet and the outlet includes a check valve for allowing fluid flow in only one direction. A regulating nozzle is provided that works in conjunction with the check valve to inject and regulate lubrication flow.

22 Claims, 1 Drawing Sheet

OILING SYSTEM ISOLATION AND REGULATOR VALVE

BACKGROUND OF THE INVENTION

The present invention relates generally to regulating check valves and more specifically to an isolation and regulator valve for use in a lubrication system of an outboard marine engine.

Typically, two-stroke outboard marine engines did not have a separate oiling system. That is, these prior art engines required pre-mixing lubricant and fuel so that the lubricant dissolves in the fuel to lubricate the engine. This required consistent, accurate measuring and agitation of the mixture. There are many disadvantages to the prior art system of pre-mixing lubricant and fuel. For example, since various two-stroke engines require different mix concentrations, many outboard marine engine owners who also own other two-stroke engine equipment, such as various lawn and garden equipment and ATV's, may store several different concentrations of oil/fuel mixture. This is not only an aggravation to the owner, but is also problematic if the containers become mixed up and the owner uses the wrong concentration for a particular two-stroke engine. While this is not catastrophic, if run over time with the wrong concentration, a two-stroke engine wears excessively.

The present invention is for use in a unique lubrication system for two-stroke engines. Such a lubrication system must provide lubrication to the fuel system to properly lubricate the fuel metering and injection system. However, it is important to prevent the backflow of any fuel from the fuel system back to the lubrication system so that fuel does not replace the lubricant in the lubrication system. It is also important to regulate the flow of lubricant into the fuel so that neither too much lubricant nor too little lubricant is added.

An additional problem in using an in-line check valve is the improper installation. If the check valve is installed backward, the flow of oil will be completely blocked which could destroy the engine.

It would therefore be advantageous to have a self-correcting valve that allows for a fool-proof installation. It would also be desirable to have a simple and inexpensive system and method of connecting a lubrication system to the fuel system of an outboard marine engine so that pre-mixing is unnecessary, backflow does not occur, and lubrication regulation is possible.

SUMMARY OF THE INVENTION

The present invention provides a system for lubricating fuel in an outboard marine engine so that pre-mixing of fuel and lubricant is not required. The present invention also provides a means for preventing fuel from entering the lubrication system. An improved device for lubricating fuel at a controlled rate is also disclosed. Further, the present invention provides a valve that does not allow reverse installation in the oil distribution system.

In accordance with one aspect of the invention, a lubrication system is provided upstream from a fuel system. An isolation check valve is positioned between the lubrication system and the fuel system. The isolation check valve contains a check ball biased by a spring so that when the lubricant pressure is great enough, the spring compresses and lubricant is allowed to flow around the check ball. The spring forces the ball back into its normally closed position as soon as the pressure is reduced after sufficient oil is allowed to pass, thus preventing the flow of fuel backwards into the lubricant system.

In accordance with another aspect of the invention, the isolation check valve has a regulating nozzle from which the lubricant is released. The regulating nozzle controls and injects the amount of lubricant into the fuel system. Rather than achieving this end with electrical means, the regulation of lubricant occurs because of the shape of the nozzle and the bias pressure on the check ball. The interior of the distal end of the isolation valve has a frusto-conical shape to assist in injecting the lubricant. Thus, not only does the nozzle provide the advantage of regulation of lubricant into the fuel system, it does so without the complexity and expense of an electrical system and with the simplicity of a check valve in a uniquely designed housing without additional moving parts to break or wear down.

Another feature of the present invention which adds to its simplicity and cost-efficiency is that installation of the isolating valve is self-correcting or "foolproof." The relative sizes of the hoses used in relation to the inlet and outlet construction of the valve does not allow the valve to be installed backwards. This prevents incorrect installation of the valve which would actually prevent the lubricant from reaching the fuel system and encourage fuel to enter the lubricant system, two actions which are antithetical to the objectives of this invention.

The present invention is further enhanced by the particular hoses used in connecting the lubricant system to the isolation valve and the isolation valve to the fuel system. It is advantageous for an owner or operator of an outboard marine engine to visualize lubricant passing into the fuel system in order to ensure that the lubricant system is functioning correctly. A semi-transparent hose can be employed to allow visualization. The present system allows the use of a semi-transparent hose only between the lubricant source and the isolation valve rather than the full distance from the lubricant source to the fuel source. The hose connecting the isolation valve to the fuel system may be a hose designed exclusively for fuel to avoid the rapid deterioration of a semi-transparent hose and thus reducing the overall cost of the system.

The hoses connected with the isolating check valve are attached firmly but are releasable in the event that the isolation valve must be removed for some reason. The hose at the regulating nozzle end of the valve is retained on the valve by a set of barbs, while the hose at the inlet end of the valve is retained by insertion into a push-to-connect fitting. The hose retained by barbs can be pulled away from the isolating check valve with some effort but will not fall off in the normal course of events. The hose retained by the push-to-connect fitting cannot be pulled from the fitting by hand unless a release mechanism on the fitting is depressed. The valve is thus kept firmly in its correct position without being permanently attached.

Various other features, objects and advantages of the present invention will be made apparent from the following detailed description and the drawings.

BRIEF DESCRIPTION OF THE DRAWINGS

The drawings illustrate a preferred embodiment as presently contemplated for carrying out the invention.

In the drawings.

DETAILED DESCRIPTION OF THE PREFERRED EMBODIMENT

Figure 1:
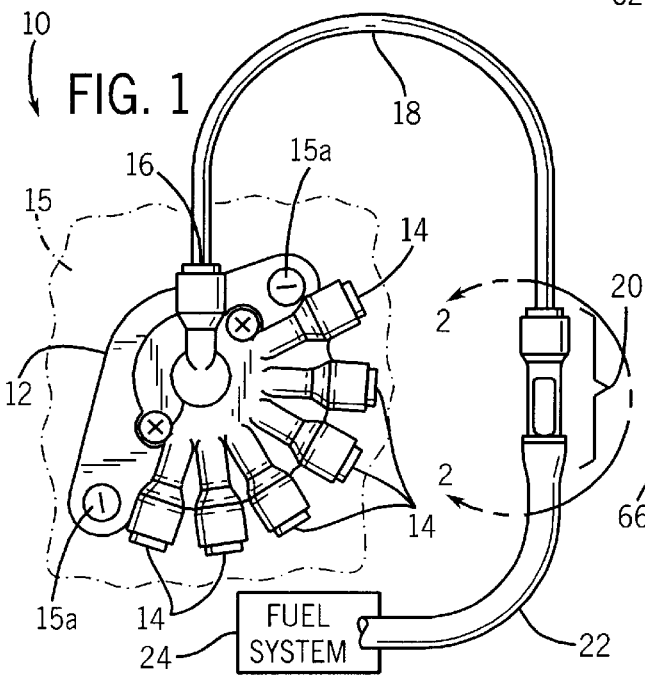
FIG. 1 is a top plan view illustrating an isolation valve according to the present invention in conjunction with a portion of a lubrication system.

With reference to FIG. 1, a lubrication system 10 includes a lubricant distribution manifold 12 having a plurality of cylinder lubrication outlets 14 for each cylinder of a two-stroke internal combustion engine, such as those used in outboard marine engines. In this embodiment, manifold 12 has six outlets 14, one for each cylinder of a six cylinder engine and is mounted to a portion of the engine 15 with mounting bolts 15*a*. The lubricant distribution manifold 12 also has a fuel system lubrication outlet 16 which is preferably at a higher elevation than the cylinder lubrication outlets 14 to purge air from the lubricant distribution manifold 12 and the lubrication system 10.

The lubrication system 10 has a first hose 18 extending from the fuel lubricant outlet 16. The first hose 18 is preferably semi-transparent to allow visualization of oil flow into the fuel system and is made of a oil-resistant material. The first hose 18 is connected to an isolation valve 20, which in turn is connected to a second hose 22 to supply lubricant to a fuel system 24 downstream. The second hose 22 is both lubricant and fuel-resistant and is preferably made of an opaque material. In this manner, while fuel and oil may mix and both be present in the second hose 22, the isolation valve 20 prevents fuel upstream to the first hose 18 and also regulates the amount of oil introduced into the fuel system.

Figure 2:
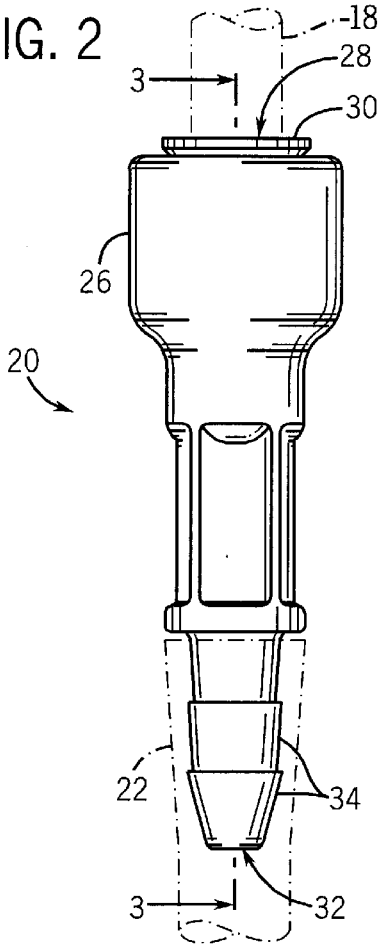
FIG. 2 is an enlarged side view of the valve of FIG. 1 taken along line 2—2 of FIG. 1.

Referring to FIG. 2, the isolation valve 20 of the present invention has an outer housing 26, which is preferably made of plastic, and more specifically, made of 30% glass-filled 6/6 nylon. The outer housing 26 has an inlet 28 containing a push-to-connect fitting 30, such as those made by Legris, Inc. The preferred fitting is a ¼" nickel-plated Legris Carstick® fitting. The push-to-connect fitting 30 retains the first hose 18 in the inlet 28 and allows a quick-release of hose 18. The outer housing 26 also has an outlet 32 which preferably carries barbs 34 to retain the second hose 22 thereon. As will be further described with reference to FIG. 3, inlet 28 and the outlet 32 are sized so as to prevent the exchange of hoses 18 and 22, respectively, to provide a fool-proof correct installation of isolation valve 20 in the lubrication system 10 of FIG. 1.

Figure 3:
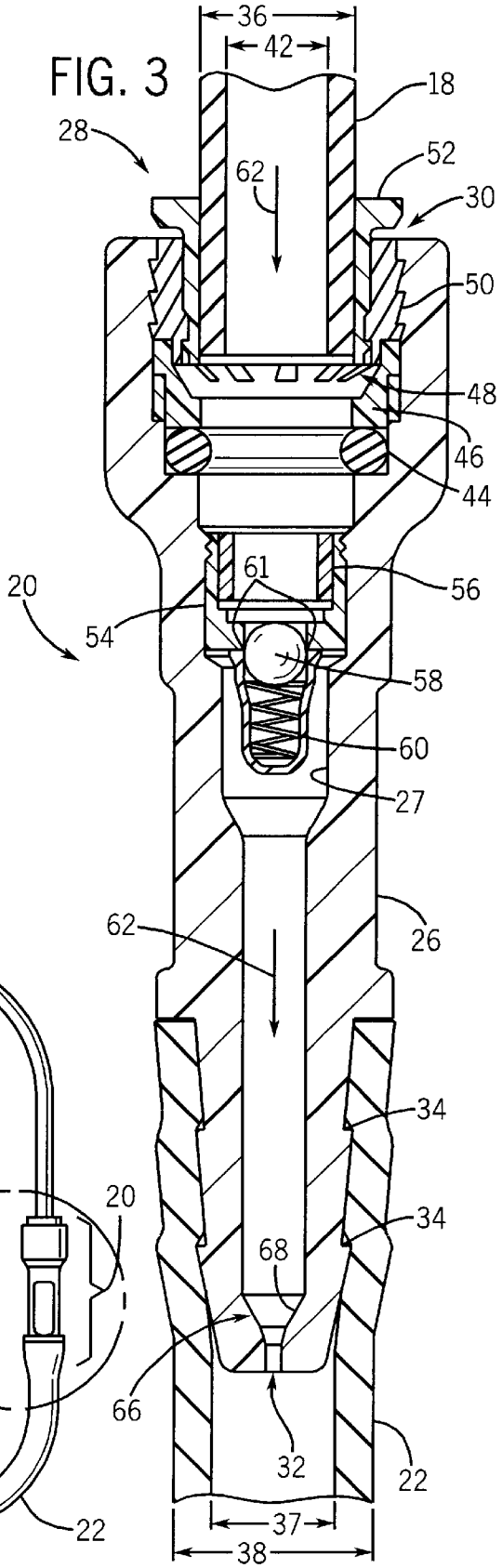
FIG. 3 is a detailed cross-section of the valve of FIG. 2 taken along line 3—3 of FIG. 2.

FIG. 3 shows a cross-section of isolation valve 20. Isolation valve 20 generally includes the outer housing 26 having an internal passage 27, a regulating nozzle 66 at the outlet end 32, and a check valve 54 located in passage 27 between the inlet 28 and the outlet 32.

In a preferred embodiment, the inner diameter of the push-to-connect fitting 36 at inlet 28 is smaller than the outer diameter 30 of the second hose 38. The outer diameter 37 of the barbs 34 of outlet end 32 is larger than the inner diameter 42 of the first hose 18. The first and second hoses 18, 22 are therefore non-interchangeable and the process of attaching the first and second hoses 18, 22 to the isolating valve 20 is self-correcting to provide fool-proof installation.

The push-to-connect fitting 30 includes a seal 44 that prevents leakage between housing 26 and the push-to-connect fitting 30. A ring sleeve 46 supports an internal gripping ring 48. The gripping ring positively clamps the first hose18 in position in the isolation valve 20. The push-to-connect fitting 30 also includes a barbed retaining sleeve 50 to hold the push-to-connect fitting 30 securely within housing 26 of the isolation valve 20. The push-to-connect fitting 30 also includes a release mechanism 52 which, when depressed, releases the gripping ring 48 to allow the first hose 18 to be removed. The release mechanism 52 of the push-to-connect fitting 30 thus allows for a quick disconnection of the first hose 18, which is otherwise firmly-secured by the gripping ring 48.

The check valve 54 in the isolation valve 20 contains a locking ring 56 to lock the check valve 54 within housing 26. The check valve 54 includes a check ball 58 and a spring 60 to bias the check ball 58 against a check valve seat 61. Pressure from the lubricant upstream against the check ball 58 accumulates until it exceeds an opposing bias force from the spring 60, at which point the spring 60 compresses and unseats the check ball 58 to permit lubricant to flow around the check ball 58 in a first direction 62 through the isolating valve 20 and out the outlet 32. The check valve 54 prevents fluid flow around the check ball 58 in a direction opposite to the flow path 62. In this manner, fuel from fuel system 24, FIG. 1, is prevented from entering the oil system. The bias force associated with spring 60 is preferably that which is necessary to account for fuel system vacuum, typically 4–8 p.s.i.

The lubricant that passes through check valve 54 is released from the outlet 32 through a regulating nozzle 66. The regulating nozzle 66 has an internal frusto-conical shape 68 to funnel oil through outlet 32. The outlet of the regulating nozzle 66 is sized such that, together with the bias force of spring 60, to limit the amount of fluid that is injected into the second hose 22 at any given time to provide proper lubrication into the fuel system.

Referring back to FIG. 1, the lubricant manifold 12 distributes lubricant pumped from the oil pump through the fuel system lubrication outlet 16 and the cylinder lubrication outlet 14. The lubricant that flows through the fuel system lubrication outlet 16 is introduced into the fuel system 24 through the isolation valve 20 without allowing fuel to infiltrate the lubricant system 10. That is, isolation valve 20 not only regulates the amount of lubricant introduced into the fuel system, it also prevents fuel from entering the lubricant system.

The isolation valve 20 is also constructed so that it cannot be installed incorrectly. The inlet and the outlet are sized to prevent the unintended reversal of the isolation valve in the oil system 10. This construction also allows the use of a semitransparent hose in just a limited section of the oil distribution to allow visualization of oil flow to the fuel system. In this manner, more cost effective opaque hose can be used in the remainder of the oil distribution system.

The present invention has been described in terms of the preferred embodiment, and it is recognized that equivalents, alternatives, and modifications, aside from those expressly stated, are possible and within the scope of the appending claims.

What is claimed is:

1. A valve to isolate fluids upstream and mix fluids downstream comprising:

a housing having an inlet to receive a first hose upstream of the valve therein and an outlet to receive a second hose downstream of the valve thereover, wherein the inlet has an inner diameter less than an outer diameter of the outlet such that the first and second hoses are non-interchangeable between the inlet and the outlet of the valve; and a check valve located in a passage between the inlet and the outlet of the housing to isolate fluid downstream while allowing fluid at the inlet to mix with fluid downstream when a given pressure is exceeded at the inlet.

2. The valve of claim 1 wherein the inlet of the housing is a female hose-receptor and the outlet of the housing is a male hose-receptor.

3. The valve of claim 1 further comprising a regulating nozzle at the outlet having a frusto-conical shaped inner surface and a nozzle outlet sized to regulate the mixing of the fluids at the outlet of the valve.

4. The valve of claim 1 further comprising a lubrication system having a lubrication distribution manifold with oil outlets for each cylinder of a two-stroke outboard marine engine and a fuel system lubrication outlet wherein the valve is connected to the fuel system lubrication outlet and isolates fuel from lubricant in the lubrication system of the two-stroke outboard marine engine.

5. The valve of claim 3 further comprising a lubrication system wherein the valve isolates fuel from lubricant in the lubricant system of a two-stroke outboard marine engine and regulates lubricant into a fuel system of the two-stroke outboard marine engine.

6. The valve of claim 1 further comprising a lubrication system having the first and second hoses and wherein the first and second hoses have different inner and outer diameters.

7. The valve of claim 6 wherein the first hose is lubricant-resistant and semi-transparent to allow visualization of lubrication, and the second hose is both lubricant and fuel resistant.

8. The valve of claim 7 wherein the second hose is opaque.

9. The valve of claim 1 further comprising a push-to-connect fitting in the inlet of the housing to retain the first hose therein, and the outlet has a barbed outer diameter to receive the second hose thereover.

10. The valve of claim 1 wherein the check valve includes a check ball and a spring to bias the check ball at approximately 4–8 p.s.i. and further comprises a regulating nozzle having a frusto-conical shaped interior to inject a desired amount of lubricant into a fuel system for lubricating the fuel system of an outboard marine engine.

11. An outboard marine engine lubrication system comprising:

a regulating check valve having a housing with an inlet to receive a first hose and an outlet to receive a second hose wherein the first and second hoses are non-interchangeable, a passage between the inlet and the outlet of the housing containing a check valve to isolate fuel at the outlet from lubricant at the inlet but allow mixing of lubricant from the inlet with fuel at the outlet, the regulating check valve also having a nozzle at the outlet to inject and regulate lubricant into a fuel system of an outboard marine engine;

a lubrication manifold having an outlet for each cylinder of the outboard marine engine and an additional outlet connected to the regulating check valve;

a first, lubricant-resistant hose connecting the inlet of the regulating check valve to the additional outlet of the lubricant manifold; and a second, lubricant and fuel resistant hose connected to the outlet of the regulating check valve to deliver a finite amount of lubricant to the fuel system of the outboard marine engine.

12. The lubrication system of claim 11 wherein the inlet of the housing is a female hose-receptor and the outlet of the housing is a male hose-receptor.

13. The lubrication system of claim 11 wherein each outlet of the lubrication manifold and the inlet of the regulating check valve has therein a push-to-connect fitting to allow quick connection and disconnection of a hose to each outlet and the inlet of the regulating check valve.

14. The lubrication system of claim 11 wherein the additional outlet of the lubricant manifold is at a higher elevation than that of each of the outlets for each cylinder to allow air to escape from the lubricant system through the regulating check valve.

15. The lubrication system of claim 11 wherein the regulating nozzle has a frustro-conical inner end to inject a desired amount of lubricant into the fuel system for lubricating the fuel system of the outboard marine engine.

16. A valve for use in isolating at least two fluids from each other at one end of the valve and mixing the at least two fluids at a second end downstream from the valve comprising:

a housing having an inlet with a female hose-receptor and an outlet with a male hose-receptor such that a hose that fits in the female hose-receptor will not fit on the male hose-receptor and a hose that fits on the male hose-receptor will not fit in the female hose-receptor;

a check valve located in a passage between the inlet and outlet of the housing; and a regulating valve in the outlet of the housing to regulate and mix a first fluid from the inlet with a second fluid downstream of the outlet and prevent the second fluid from mixing with the first fluid upstream of the check valve.

17. The valve of claim 16 further comprising a lubrication system having a lubrication distribution manifold with oil outlets for each cylinder of a two-stroke outboard marine engine and a fuel system lubrication outlet wherein the valve is connected to the fuel system lubrication outlet and isolates fuel from lubricant in the lubrication system of the two-stroke outboard marine engine.

18. The valve of claim 16 further comprising a lubrication system having first and second hoses attached to the inlet and outlet, respectively, and wherein the first and second hoses have different inner and outer diameters.

19. The valve of claim 18 wherein the first hose is lubricant-resistant and semi-transparent to allow visualization of lubrication, and the second hose is lubricant and fuel resistant and opaque.

20. The valve of claim 16 further comprising a push-to-connect fitting in the inlet of the housing to retain a first hose therein, and the outlet has a barbed outer diameter to receive a second hose thereover.

21. A valve to isolate fluids upstream and mix fluids downstream comprising:

a housing having an inlet to receive a first hose upstream of the valve and an outlet to receive a second hose downstream of the valve, wherein the inlet has an inner diameter less than an outer diameter of the outlet such that the first and second hoses are non-interchangeable between the inlet and the outlet of the valve;

a check valve located in a passage between the inlet and the outlet of the housing to isolate fluid downstream while allowing fluid at the inlet to mix with fluid downstream when a given pressure is exceeded at the inlet; and a regulating nozzle at the outlet having a frusto-conical shaped inner surface and a nozzle outlet sized to regulate the mixing of the fluids at the outlet of the valve.

22. A valve to isolate fluids upstream and mix fluids downstream comprising:

a housing having an inlet to receive a first hose upstream of the valve and an outlet to receive a second hose downstream of the valve, wherein the inlet has an inner diameter less than an outer diameter of the outlet such that the first and second hoses are non-interchangeable between the inlet and the outlet of the valve;

a check valve located in a passage between the inlet and the outlet of the housing to isolate fluid downstream while allowing fluid at the inlet to mix with fluid downstream when a given pressure is exceeded at the inlet; and wherein the check valve includes a check ball and a spring to bias the check ball at approximately 4–8 p.s.i. and further comprises a regulating nozzle having a frusto-conical shaped interior to inject a desired amount of lubricant into a fuel system for lubricating the fuel system of an outboard marine engine.

* * * * *